US007207871B1

(12) United States Patent
Zuniga et al.

(10) Patent No.: US 7,207,871 B1
(45) Date of Patent: Apr. 24, 2007

(54) CARRIER HEAD WITH MULTIPLE CHAMBERS

(75) Inventors: Steven M. Zuniga, Soquel, CA (US); Hung Chih Chen, Sunnyvale, CA (US); Thomas Brezoczky, San Jose, CA (US); Steven T. Mear, Austin, TX (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 11/245,867

(22) Filed: Oct. 6, 2005

(51) Int. Cl.
*B24B 5/00* (2006.01)

(52) U.S. Cl. ..... 451/288; 451/289; 451/388

(58) Field of Classification Search ..... 451/41, 451/285–289, 388, 397, 398
See application file for complete search history.

(56) References Cited

U.S. PATENT DOCUMENTS 5,605,488 A 2/1997 Ohashi et al.
5,762,539 A 6/1998 Nakashiba et al.
6,390,905 B1 5/2002 Korovin et al.
6,764,387 B1 * 7/2004 Chen ..... 451/41
6,872,131 B2 3/2005 Brown
6,926,585 B2 * 8/2005 Togawa ..... 451/5
2002/0042246 A1 * 4/2002 Togawa et al. ..... 451/288

* cited by examiner

*Primary Examiner*—Dung Van Nguyen
(74) *Attorney, Agent, or Firm*—Fish & Richardson

(57) ABSTRACT

A system for chemical mechanical polishing having a carrier head with pressurizeable chambers that can be configured into pressure zones is described. The system includes a carrier head with a membrane for contacting a substrate during polishing. Pressurizeable chambers behind the membrane are in communication with pressure inputs. The pressure inputs can each supply a different pressure to the pressurizeable chambers. Some of the pressurizeable chambers can be in communication with more than one pressure input. Zones of pressure can be arranged, where each zone includes one or more pressurizeable chambers. The zones can be configurable by altering the pressurizeable chambers that make up each zone.

21 Claims, 7 Drawing Sheets

CARRIER HEAD WITH MULTIPLE CHAMBERS

BACKGROUND

This invention relates to carrier heads for controlling the pressure applied to a substrate during chemical mechanical polishing.

An integrated circuit is typically formed on a substrate by the sequential deposition of conductive, semiconductive or insulative layers on a silicon substrate. One fabrication step involves depositing a filler layer over a non-planar surface, and planarizing the filler layer until the non-planar surface is exposed. For example, a conductive filler layer can be deposited on a patterned insulative layer to fill the trenches or holes in the insulative layer. The filler layer is then polished until the raised pattern of the insulative layer is exposed. After planarization, the portions of the conductive layer remaining between the raised pattern of the insulative layer form vias, plugs and lines that provide conductive paths between thin film circuits on the substrate. In addition, planarization is needed to planarize the substrate surface for photolithography because of limited depth of focus of a lithography instrument.

Chemical mechanical polishing (CMP) is one accepted method of planarization. This planarization method typically requires that the substrate be mounted on a carrier or polishing head of a CMP apparatus. The exposed surface of the substrate is placed against a rotating polishing disk pad or belt pad. The polishing pad can be either a "standard" pad or a fixed-abrasive pad. A standard pad has a durable roughened surface, whereas a fixed-abrasive pad has abrasive particles held in a containment media. The carrier head provides a controllable load on the substrate to push it against the polishing pad. A polishing liquid, such as a slurry including abrasive particles, is supplied to the surface of the polishing pad.

SUMMARY

The invention provides techniques for increasing the number of apparent pressure chambers in a carrier head without a proportionate increase in the number of pressure inputs to the carrier head.

In general, in one aspect, the invention features a carrier head for chemical mechanical polishing of a substrate. The carrier head includes a first passage configured to be connected to a first pressure input and a second passage configured to be connected to a second pressure input. The carrier head also includes a base assembly that includes the first and second passages. A flexible membrane is coupled to the base assembly. The membrane has a generally circular main portion with a lower surface that provides a substrate-mounting surface. The volume between the base assembly and the flexible membrane forms a plurality of pressurizable chambers. Each of the first and second passages are in communication with at least one of the plurality of pressurizable chambers and there is a greater number of pressurizable chambers than number of pressure inputs.

The carrier head may also include an inner membrane that forms at least one of the plurality of pressurizable chambers. The carrier head may also include a plurality of valves, such as solenoid or MEMS valves, wherein each of the plurality of valves is associated with one of the plurality of pressurizable chambers. The valves can be electronically controlled. The carrier head can have an equal number of pressurizable chambers as number of valves or a greater number of pressurizable chambers than number of valves. The valves can be controllable to create a plurality of pressure zones, wherein each zone includes one or more of the plurality of pressurizable chambers. The first and second passages can be coupled to each of the plurality of pressurizable chambers. The carrier head may also include a valve controller, wherein the valve controller controls each of the plurality of valves between a first position and a second position. The carrier head may have sectioning portions that are secured to the base assembly, wherein the sectioning portions delineate sides of each of the plurality of pressurizable chambers. The sectioning portions can be annular walls, thereby forming pressurizable chambers that are annularly shaped. Alternatively, the pressurizable chambers can be configured in a sectional configuration. The base assembly can include a plate body, which includes a manifold, the manifold fluidly coupling the first and second passages to the plurality of pressurizable chambers. The manifold may be reconfigured, such that a coupling between a first pressurizable chamber to the first passage can be changed to a coupling between the first pressurizable chamber and the second passage. The plate body can be connected to a part of the base assembly with a fastener.

In another aspect, the invention is directed to a component for a carrier head having a plate body. The plate body has a plurality of chamber areas along a bottom surface. A plurality of passages extend through the plate body, each passage for connecting a pressure input to at least one of the chamber areas, wherein a number of pressure inputs connected through the plate body is less than a number of chamber areas.

The plate body may have a manifold for connecting a passage to a chamber area. The manifold may be configurable such that in one configuration the manifold determines a first mapping between passages and chamber areas and in a second configuration the manifold determined a second mapping between passages and chamber areas, such that the first mapping is different from the second mapping.

In yet another aspect, the invention is directed to a method of forming a carrier head. A base assembly with a first passage and a second passage is provided, where the first passage is configured to be in fluid communication with a first pressure source and a second passage is configured to be in fluid communication with a second pressure source. A substrate backing assembly with a plurality of chambers is provided, wherein a number of chambers is greater than a number of pressure sources. The first passage is coupled to at least a first chamber and a second chamber where a connection between the first passage and the first and second chambers is configurable such that the first passage is in fluid communication with one of the first chamber, the second chamber or both chambers.

Coupling the first passage to at least a first chamber and a second chamber may include coupling the first passage to a valve that has an output in fluid communication with at least one of the first or second chambers. Providing a substrate backing assembly may include providing a substrate backing assembly having a desired manifold design and coupling the first passage to at least a first chamber and a second chamber may include coupling the substrate backing assembly to the base.

In another aspect, the invention is directed to a method of using a carrier head. A substrate is retained under a carrier head so that a front side of the substrate is in contact with a polishing surface. The carrier head includes a substrate backing assembly that applies pressure to a backside of the substrate. The substrate backing assembly includes a plurality of chambers, wherein a chamber is in communication with a first pressure input. Pressure is applied to the backside of the substrate, such that the chamber is pressurized to a pressure applied by the first pressure input. A relative motion is created between the substrate and the polishing surface. The chamber is then caused to be in fluid communication with a second pressure input and not in communication with the first pressure input.

Causing the chamber to be in communication with a second pressure input can include sending an electrical signal to a valve to cause the valve to change. The method can include continuing to polish the substrate after causing the chamber to be in communication with a second pressure input. The substrate backing assembly may include a first manifold and causing the chamber to be in communication with a second pressure input may include changing the first manifold for a second manifold.

In yet another aspect, the invention includes a method of forming a component of a carrier head. A plate body is formed with a plurality of passages for connecting to a plurality of pressure inputs and a plurality of chamber areas. The chamber areas are on a bottom surface of the plate body and a number of pressure inputs is less than a number of chamber areas.

Implementations of this invention may include one or more of the following advantages. As compared to a conventional multi-chambered carrier head, the number of apparent pressure chambers in a carrier head may be increased without a proportionate increase in the number of pressure inputs to the carrier head. Alternatively, the number of pressure inputs may be reduced while maintaining the same number of chambers. By limiting the number of pressure inputs that are required to make a configurable carrier head system, the system may be simpler than a carrier head that requires more pressure inputs. A simpler carrier head system may require fewer parts and be easier to build and maintain. Chambers may be grouped to form a set of chambers controlled by a common pressure input, and the members of the set may be configurable. The configuration may be selected by software, and may be changed in-situ during polishing or between polishing operations. The pressure distribution system may be used with many different membrane configurations. The carrier head is adaptable to a variety of polishing processes and parameters. Due to the improved flexibility of being able to change configurations, polishing uniformity may be increased, and yield may be improved. The ability to have a selection of zone configurations and to change between different zone configurations may result in better resolution on polishing control. Greater control over the polishing process may result in higher die yield. There may be a limit to the number of zones that can be fit into a membrane assembly. There may be a limit to the number of pneumatic ports in a drive shaft. For any given number of input inputs, more control over the polishing profile may be obtained by adding a chamber to a carrier head assembly and without adding an additional pressure input. The methods and assemblies described herein may be used with existing carrier head structures.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1A:
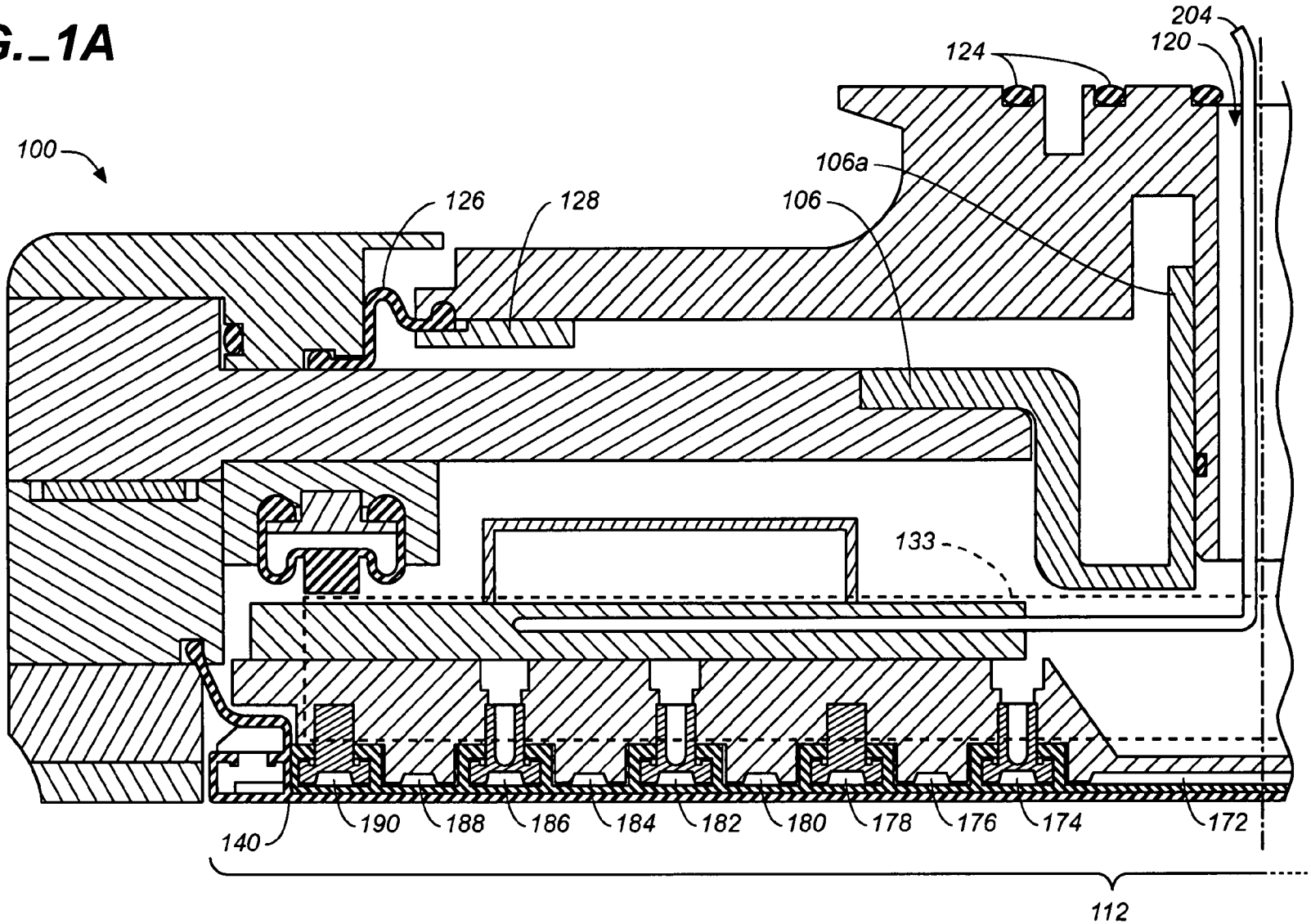
FIGS. 1A and 1B show a schematic of cross section of a substrate carrier head.
Figure 1B:
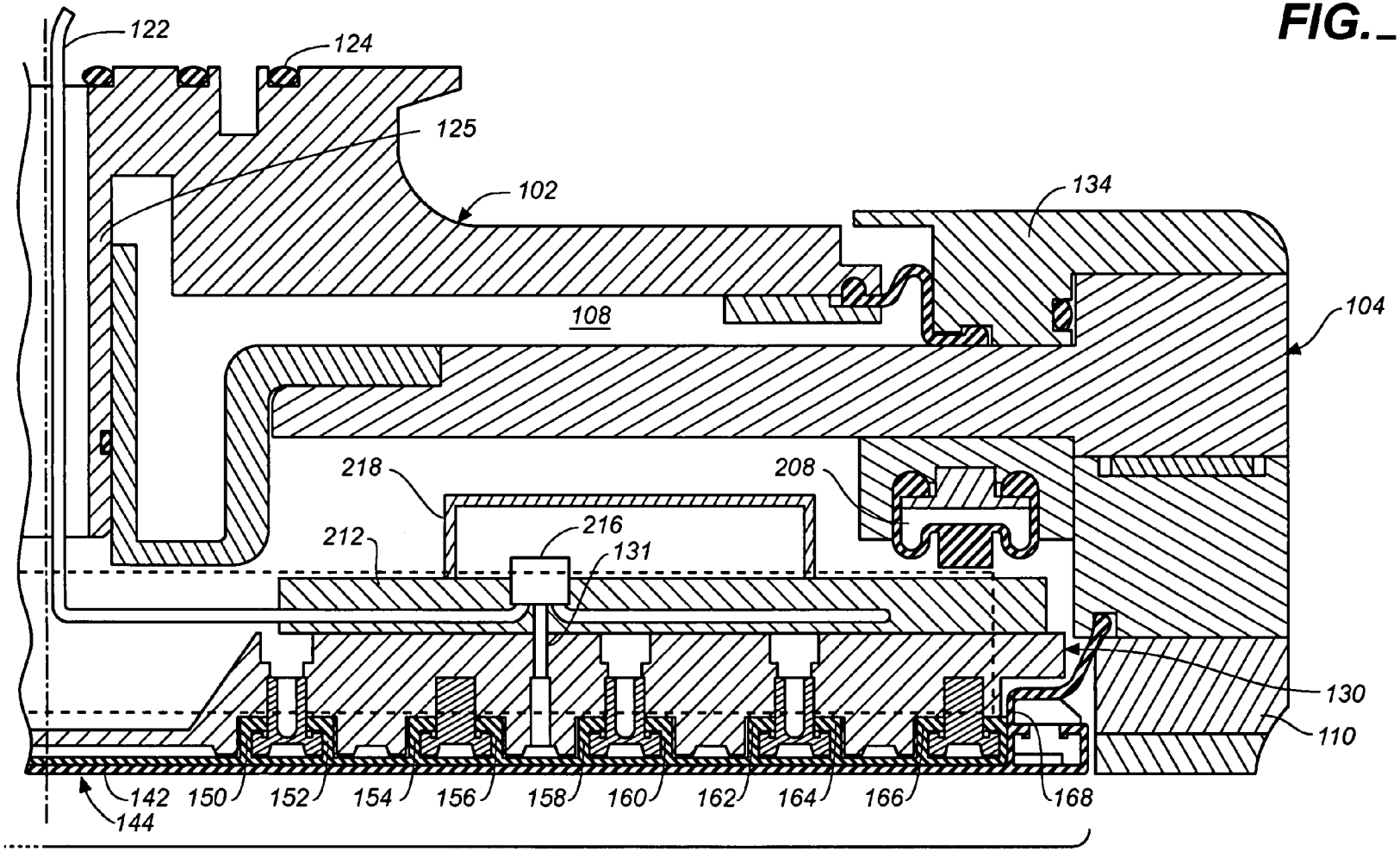

Referring to FIGS. 1A and 1B, one embodiment of a carrier head 100 is described. The carrier head 100 includes a housing 102, a base assembly 104, a gimbal mechanism 106 (which may be considered part of the base assembly), a loading chamber 108, a retaining ring 110, and a substrate backing assembly 112 which includes pressurizable chambers. A description of a similar carrier head may be found in U.S. Pat. No. 6,183,354, filed May 21, 1997, U.S. Pat. No. 6,857,945, filed Nov. 13, 2000, and U.S. patent application Ser. No. 10/810,784, filed Mar. 26, 2004, U.S. Pat. No. 6,764,387, filed Mar. 7, 2003, the entire disclosures of which are incorporated herein by reference.

The housing 102 can be generally circular in shape and can be connected to a drive shaft to rotate therewith during polishing. A vertical bore 120 may be formed through the housing 102, and, optionally, one or more additional passages 122 (only one is shown) may extend through the vertical bore 120 for pneumatic control of the carrier head. A cylindrical annular flange 125 can extend downwardly from the housing 102, and a cylindrical portion 106*a* of the gimbal 106 extends upward outside flange 125 to restrain the base assembly 104 from lateral motion while permitting the base assembly 104 to move vertically. O-rings 124 may be used to form fluid-tight seals between the passages through the housing and passages through the drive shaft. Electrical wires 204 can also extend through the vertical bore 120, allowing electrical signals to be transmitted to components within the base assembly 104. Alternatively, the electrical wires 204 can extend into the base assembly 104 through another part of the carrier head.

The base assembly 104 is a vertically movable assembly located beneath the housing 102. The base assembly 104 includes a plate body 130, an outer clamp ring 134, and the gimbal mechanism 106. An inner edge of a generally ring-shaped rolling diaphragm 126 may be clamped to the housing 102 by an inner clamp ring 128, and an outer edge of the rolling diaphragm 126 may be clamped to the base assembly 104 by the outer clamp ring 134 to form the loading chamber 108 between the housing 102 and the base assembly 104 to apply a load, i.e., a downward pressure, to the base assembly 104. The vertical position of the base assembly 104 relative to the polishing pad is also controlled by the loading chamber 108. A pressurizable chamber 208 can apply pressure to the substrate backing assembly 112.

The substrate backing assembly 112 includes a flexible membrane 140 with a generally flat main portion 142. A lower surface 144 of the main portion 142 provides a mounting surface for a substrate. The volume between the main portion 142 of the membrane and the base assembly 104 is divided into a plurality of chambers. In the implementation shown, the volume is divided by concentric annular walls 150, 152, 154, 156, 158, 160, 162, 164 and 166 that extend from the main portion 142 of the membrane 140. An outermost wall 168 is clamped between the base assembly 104 and the retaining ring 110. The other walls can be clamped to the base assembly 104 with clamp rings. The walls can be an integral part of the membrane, can be formed from a separate body and attached to the backside of the membrane or not attached to the membrane. Although ten annular walls are shown, there can be more or fewer walls, as determined by the desired number of chambers. Other carrier head configurations can be used to form the chambers, such as a carrier head with additional membranes or bladders between the membrane 140 and the base assembly 104. A description of a such membrane configurations may be found in U.S. Pat. No. 6,722,965, filed Jun. 10, 2001, and in U.S. Pat. No. 6,183,354, filed May 21, 1997, which are incorporated herein by reference.

The volume between the base assembly 104 and the membrane 140 that is sealed within the first wall 150 provides a first circular chamber 172. The volume between the base assembly 104 and the membrane 140 that is sealed between the first wall 150 and the second wall 152 provides a second pressurizable annular chamber 174 surrounding the first chamber 172. Similarly, the volume between the other adjacent pairs of walls provide additional annular chambers 176–190. Each chamber can be wider, narrower or the same width as an adjacent chamber. The annular chambers can each have a consistent width, thus the annular configuration can create polishing zones of uniform radial width around the substrate. Although particular chamber configurations are described herein, virtually any desired chamber configuration or zone configuration can be used. A chamber is defined by the physical structure of a membrane or membranes, the carrier head, or the substrate backing assembly 112. A zone includes one or more chambers and can be configurable, based on how many chambers are included in the zone at any time.

As described further below, the chambers can be fluidly coupled to multiple pressure sources (not shown), such as pneumatic inputs, pumps, or pressure or vacuum lines. The coupling can be adjustable so that the chamber is only open to one pressure source at a time. If each chamber is separated from the other chambers, fluid does not readily pass from one chamber to another. However, sets of chambers can be fluidly coupled to one another, even temporarily. The chambers can be pressurized to different pressures. Each chamber or set of contiguous chambers that is at the same pressure makes up a zone. A 1:1 mapping of pressure inputs to chambers is not required. In fact, the carrier head can have fewer inputs than chambers.

The base assembly 104 includes a pressure routing assembly 133 for controlling which chambers are fluidly coupled to which pressure sources. The pressure routing assembly 133 can be mounted on the plate body 130 or be within the plate body 130. The pressure routing assembly 133 can be fluidly coupled to the pressure sources by the vertical bore 120 or passages 122 through the housing 102. Similarly, each chamber 172–190 is fluidly connected to the pressure routing assembly 133 by an associated passage 131 through the plate body 130. Any of the fluid couplings can include tubing, such as flexible or rigid tubing, or simply be a channel through the base assembly 104 or plate body 130.

The pressure routing assembly 133 can include a component that has valves 216 or a manifold without valves that control the connections between the passages 131 and the passages 122 so as determine which chambers 172–190 are coupled to which pressure sources. Only one valve 216 is shown in a valve supporting component 212, although the valve supporting component 212 can include many valves. The pressure routing assembly 133 can also include a manifold with a fixed pressure routing and valves, that is, a hybrid between the valve supporting component and a manifold. The pressure routing assembly 133 can be configurable (i.e., the connections of the passages 131 to the passages 122 can be adjusted) or non-configurable (i.e., the connections are fixed). In particular, for at least one pressure source, the pressure routing assembly 133 can connect multiple chambers to the input for that pressure source. Thus, the number of pressure inputs to the pressure routing assembly 133 can be less than the number of chambers. Equivalently, at least two of the chambers can be connected to a common pressure source. The chambers need not be contiguous chambers. A housing 218 can cover each of the valves.

If the pressure routing assembly is configurable, in some implementations the configuration can be changed without removing the pressure routing assembly 133 from the carrier head (and in some implementations the configuration can be changed during a polishing operation), whereas in some implementations the pressure routing assembly 133 may need to be removed to modify the configuration. If the pressure routing assembly 133 is configurable, then the set of chambers that are coupled to the common pressure source can be changed.

With separate chambers or groups of chambers the pressurization and load applied by the associated portion of the flexible membrane 140 on the substrate can be independently controlled. This permits different pressures to be applied to different regions of the substrate during polishing, thereby compensating for non-uniform polishing rates or for non-uniform thickness of the incoming substrate.

During polishing, the pressure in the chambers can be increased or decreased to change the amount of pressure applied to a corresponding area of a substrate. The amount of pressure applied can be changed by introducing fluid into or removing fluid from the chamber. The chambers can be grouped into zones of pressure, such that each zone includes one or more chambers. Thus, a substantially uniform pressure can be applied across a particular zone. By changing the setting of a valve or the routing of a manifold, the specific chambers belonging to each zone can be changed. Because any or all of the chambers can be pressurized to different pressures, a mechanism for maintaining the overall pressure applied to the substrate can be included in the carrier head. In one implementation, changing the downward force applied by the pressurizeable chamber 208 can keep the overall pressure applied to a substrate constant and compensate for changes in pressure that are applied at individual chambers.

In one implementation, the pressure routing assembly includes valves to control which chamber belongs to which zone, and the position of each valve can be changed by an input while the carrier head remains secured to the drive shaft. For this implementation, electrical wires 204 in the carrier head can carry a signal from a controller to the valves. The controller can include software, such as a software-implemented polishing recipe. Such a recipe can include a set of polishing parameters, such as time, speed, slurry rate and pressure, and can also include the time at which each valve is switched to connect the desired pressure source with at least one of the chambers. The controller can be a part of or be in communication with a computer system, such as a computer system including instructions operable to send signals to open or close the valves. The computer system can be programmed with the recipe for changing the state of the valves, i.e., open to closed or closed to open. Alternatively, the computer system can receive feedback from a monitoring system that measures the film thickness or the amount of material removed by polishing. The substrate measurements can be used to determine whether the valves are to be opened or closed based on the feedback. The controller can also accept commands, such as commands input by a user, and transmit signals to the valve assembly that implements the commands. The state of the valves can be changed during polishing of a substrate or between polishing substrates.

In another implementation, the pressure routing assembly includes valves to control which chamber belongs to which zone, but the position of each valve must be modified mechanically. For example, to adjust the valves the carrier head can be removed from the drive shaft so that the pressure routing assembly can be accessed, and the valves can be adjusted manually. In this implementation, the zone can be changed by an input while the pressure routing assembly remains secured to the plate 130.

Figure 2:
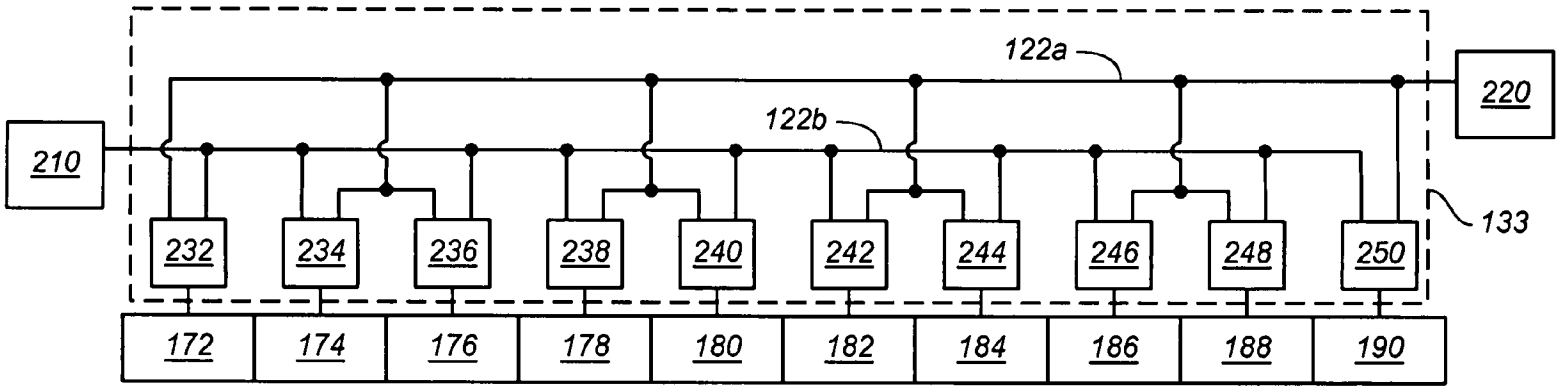
FIG. 2 is a schematic of pressure chambers that are each associated with a valve for digital control.

Referring to FIG. 2, in one embodiment (which is applicable to either implementation noted above), the carrier head can include two passages, where one passage 122*a* is connected to a relatively high pressure source 220 and the other passage 122*b* is connected to a relatively low pressure source 210. The pressure routing assembly 133 includes valves 232–250, e.g., solenoid valves or MEMS valves, for each chamber 172–190. Each chamber 172–190 can be alternately coupled to one of the passages 122*a* or 122*b* by the associated valves 232–250. Thus, each valve 232–250 can be switched between allowing fluid to pass from the high pressure source 220 to the associated chamber and allowing fluid to pass from the low pressure source 210 to the associated chamber. At any given time, each chamber is at one of the two pressures.

As many zones can be formed behind the substrate as there are chambers. At the other extreme, the same pressure can be applied across the back of the substrate, forming one large zone. The chambers can be at any desired pressure, such as between about 0.1 psi (gauge) up to 6 psi (gauge) or even higher. In one implementation, chambers connected to the high pressure input are around 3.0 psi (gauge), while chambers connected to the low pressure input are around 2.0 psi (gauge). In another implementation, the difference between the pressure in the high and low pressure inputs is between 10–20%. In some systems, a smaller pressure differential between adjacent chambers, or adjacent zones, causes the carrier head to perform better than when there is a large pressure differential between chambers or zones. However, the chambers can be adjusted to any desired pressure.

Figure 3:
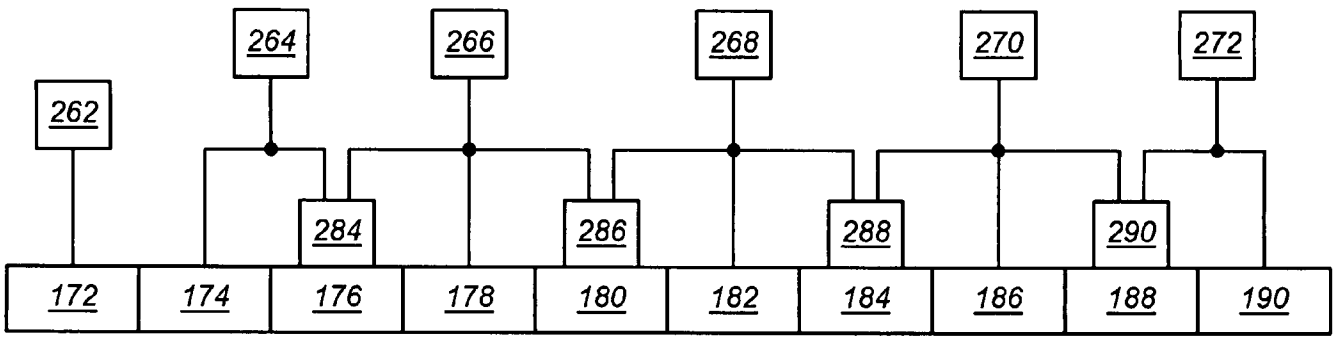
FIG. 3 is a schematic of configurable pressure zones.

Referring to FIG. 3, in another embodiment (which is applicable to any of the implementations noted above), not every chamber has an associated valve. In this embodiment, chambers 176, 180, 184, 188 are connected to associated valves 284, 286, 288, 290, whereas chambers 172, 174, 178, 182, 186 and 190 are connected directly to pressure sources 262, 264, 266, 268, 270 and 272, respectively. Each valve can connect its associated chamber to one of the two pressure sources. For example, chambers 174 and 178 are connected to pressure sources 264 and 266, respectively, and chamber 176 can be connected by valve 284 to either pressure source 264 or 266. The central chamber 172 may have a dedicated pressure source 262. Thus, each zone may include one, two or three chambers.

With four valves each having two inputs, sixteen configurations are possible. Thus, with six inputs and four valves, a carrier head with a membrane having ten chambers can be configured as sixteen different six-chamber carrier heads. A few examples of zone configurations possible with the implementation of FIG. 3 are shown in table 1 below.

TABLE 1

| | | Inputs | | | | | |
|---|---|---|---|---|---|---|---|
| | | 262 | 264 | 266 | 268 | 270 | 272 |
| Configuration | 1 | 172 | 174 | 176, 178 | 180, 182 | 184, 186 | 188, 190 |
| | 2 | 172 | 174, 176 | 178, 180 | 182, 184 | 186, 190 | 190 |
| | 3 | 172 | 174 | 176, 178, 180 | 182 | 184, 186, 188 | 190 |
| | 4 | 172 | 174, 176 | 178 | 180, 182, 184 | 186 | 188, 190 |

In general, the number of zones that can be configured is determined by the number of valve positions (X) to the power of the number of valves (Y), or $X^Y$. The valves can have two settings. However, other types of valves, such as valves capable of routing more than two inputs, can also be used.

Figure 4:
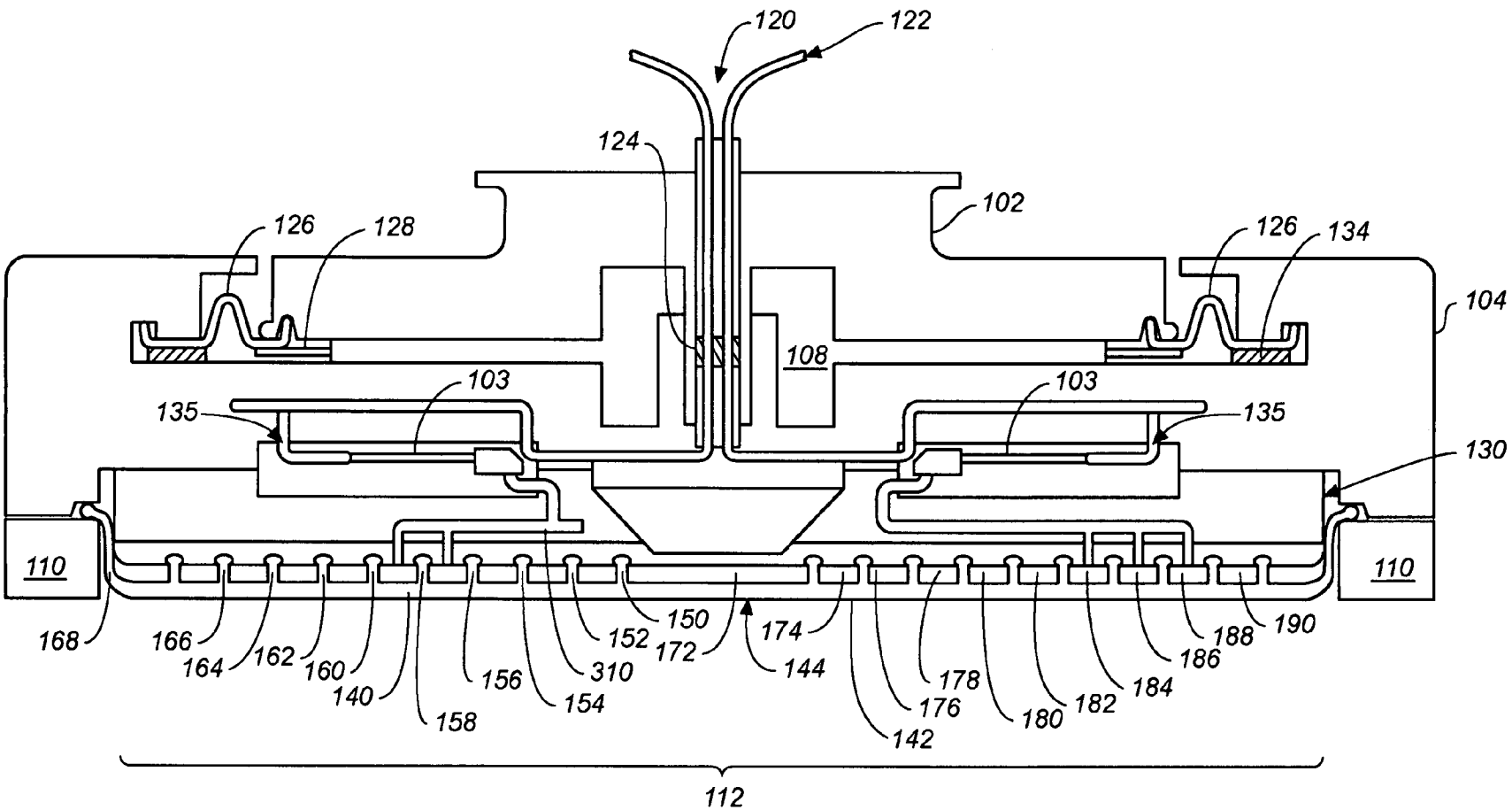
FIG. 4 is a schematic of a carrier head having multiple zones.

FIG. 4 shows another implementation of a carrier head having multiple zones. The carrier head can include many of the same or similar components as the carrier head in FIG. 1, such as a housing 102, a base assembly 104, a gimbal mechanism 106, passages 122 and a flexible membrane 140. However, the pressure routing assembly does not includes valves, but instead includes a manifold 310 to couple the chambers 172–190 to two or more pressure inputs (not shown). The manifold 310 can be a part of the plate body 130. If the manifold 310 is part of the plate body 130, the manifold 310 configuration can be changed by exchanging the plate body 130 for another plate body with a manifold 310 having the desired configuration. As shown, a portion of the plate body 130, a membrane support 192, can be removed from the rest of the plate body 130 and exchanged for a membrane support 192 with the desired configuration. Alternatively, the manifold 310 can be removable from or changeable within the plate body 130. The manifold 310 may be changeable by changing the connection of a fluid conduit, such as a tube, or by replacing the entire manifold 310. A manifold 310 coupling two or more pressure inputs to a single chamber can also be changed by opening one of the connections to a pressure input while closing the other connections off. With any type of manifold 310, the plate body 130 or a portion of the plate body 130 can be removed from the carrier head to make any desired changes.

Figure 5:
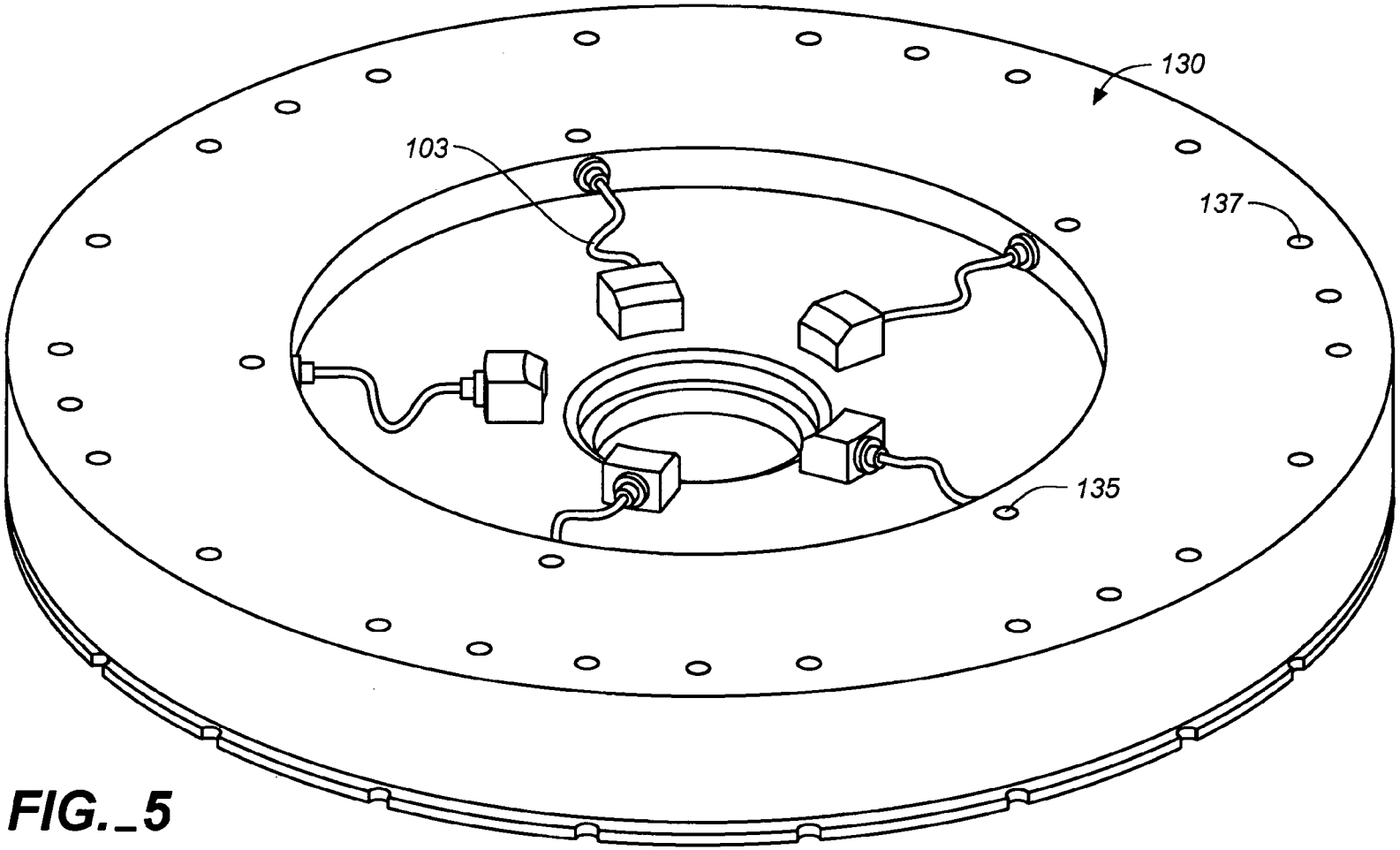
FIG. 5 is a perspective top view of a plate body.

Referring to FIG. 5, in one implementation, the manifold 310 is formed in the plate body 130. The plate body 130 can have input holes 135 leading to flexible tubing 103. The flexible tubing 103 leads inside the plate body 130 to the manifold 310 located inside the body. The plate body 130 fits snug with the base 104, so that passages 122 are in fluid communication with flexible tubing 103 through holes 135. The flexible tubing 103 leads to the manifold 310. The portion of the carrier head that is removed for changing the hardware configuration can be attached to the carrier head with a fastener, such as a screw or other fastener that allows for replacement. The plate body 130 can include holes 137 for receiving the fasteners.

Figure 6:
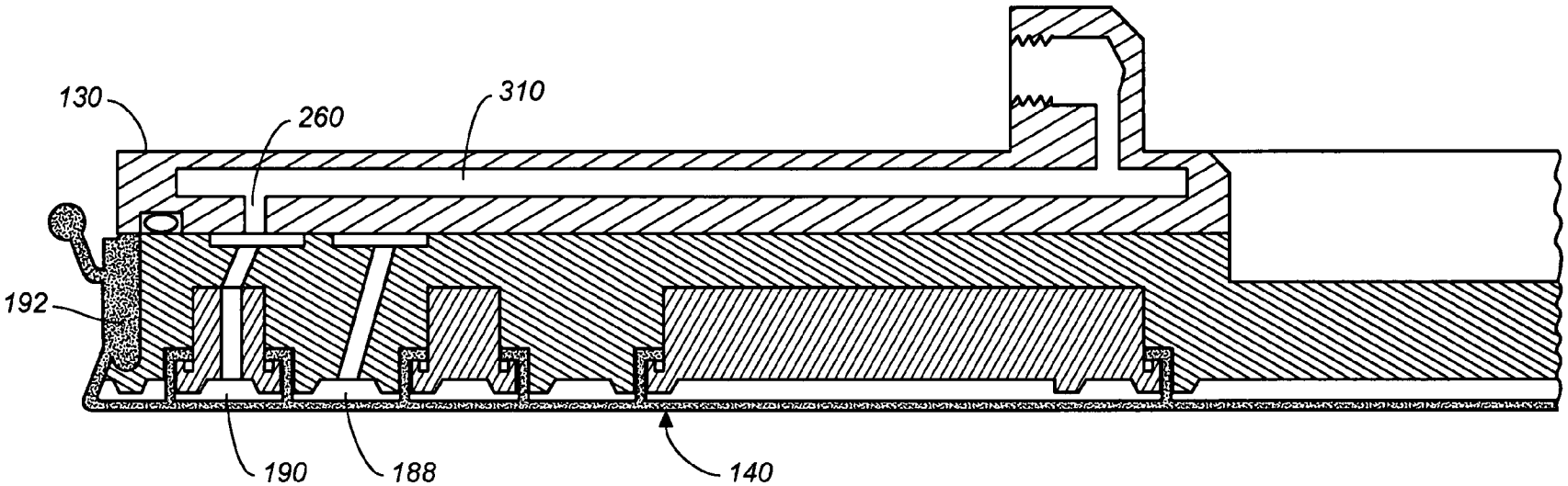
FIG. 6 is a cross-sectional view of a portion of a plate body.

Referring to FIG. 6, the flexible tubing 103 is in fluid communication with a tube 260 of the manifold 310. The tube 260 is in communication with a chamber 190. The tube 260 can lead to a chamber area. The chamber 190 may not be a complete chamber without a membrane or other substrate backing member covering the chamber area.

Figure 7:
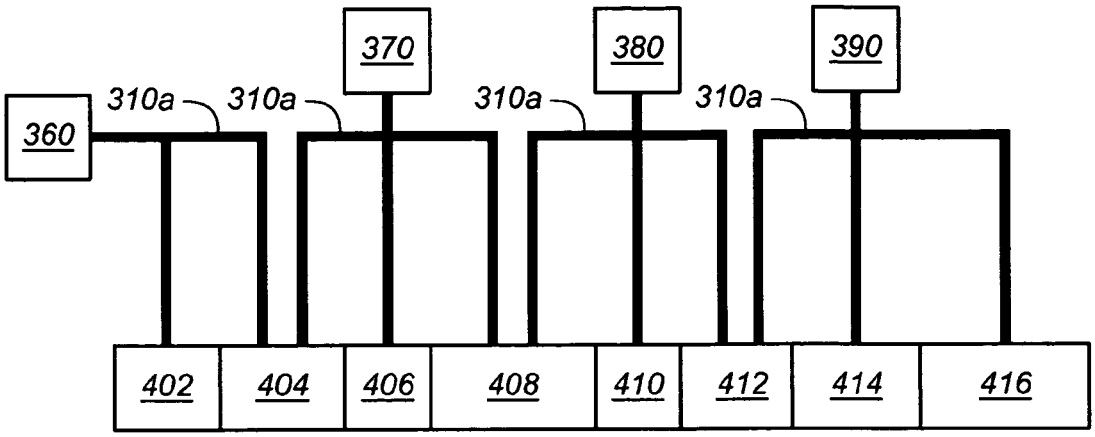
FIG. 7 is a schematic of the pressure zones in the carrier head of FIG. 4.

In one embodiment of a carrier head having a manifold (and thus applicable to the implementation described with reference to FIGS. 4–6), the zones can be hardware configured, as shown in FIG. 7. Here, a manifold 310*a* determines the configuration of the pressure zones rather than valves. A first pressure input 360 can be connected to first 402 and second chambers 404. A second pressure input 370 can be connected to the second 404, third 406 and fourth 408 pressure chambers. A third pressure input 380 can be connected to the fourth 408, fifth 410 and sixth 412 pressure chambers. A fourth pressure input 390 can be connected to the sixth 412 seventh 414 and eighth 416 pressure chambers. Of the chambers 404, 408, 412 that have two pressure inputs, the manifold design can determine which pressure is routed to the chamber. By altering the manifold, eight possible combinations are available with the arrangement shown in FIG. 7.

Many different membranes can be used with the above disclosed chamber control methods. For example, in the implementations described above, the membrane is a single external membrane with a single-flexure for attaching to the base assembly. An inner membrane or bladder or other member of the substrate backing assembly can form the chambers. The outer membrane is not necessary for creating a carrier head with configurable zones. The outer membrane can serve to keep the member that defines the chambers from wearing out or becoming contaminated. The outer membrane may be simpler to replace than multiple inner membranes, a membrane with a complex attachment scheme or other types of assemblies that form multiple chambers. In other implementations, the carrier head includes a dual membrane, with an outer membrane and one or more inner membranes that apply pressure to the inner surface of the outer membrane. A similar carrier head is disclosed in U.S. Pat. No. 6,722,965, filed Jun. 10, 2001, which is incorporated herein by reference. In addition, the membrane can have a dedicated edge-control zone. The rate of polishing tends to be the most non-uniform at the edge of the substrate, making edge-control useful in achieving a uniformly polished substrate. The membranes can have walls, as described above, or separate chambers can be formed by bladders.

Figure 8:
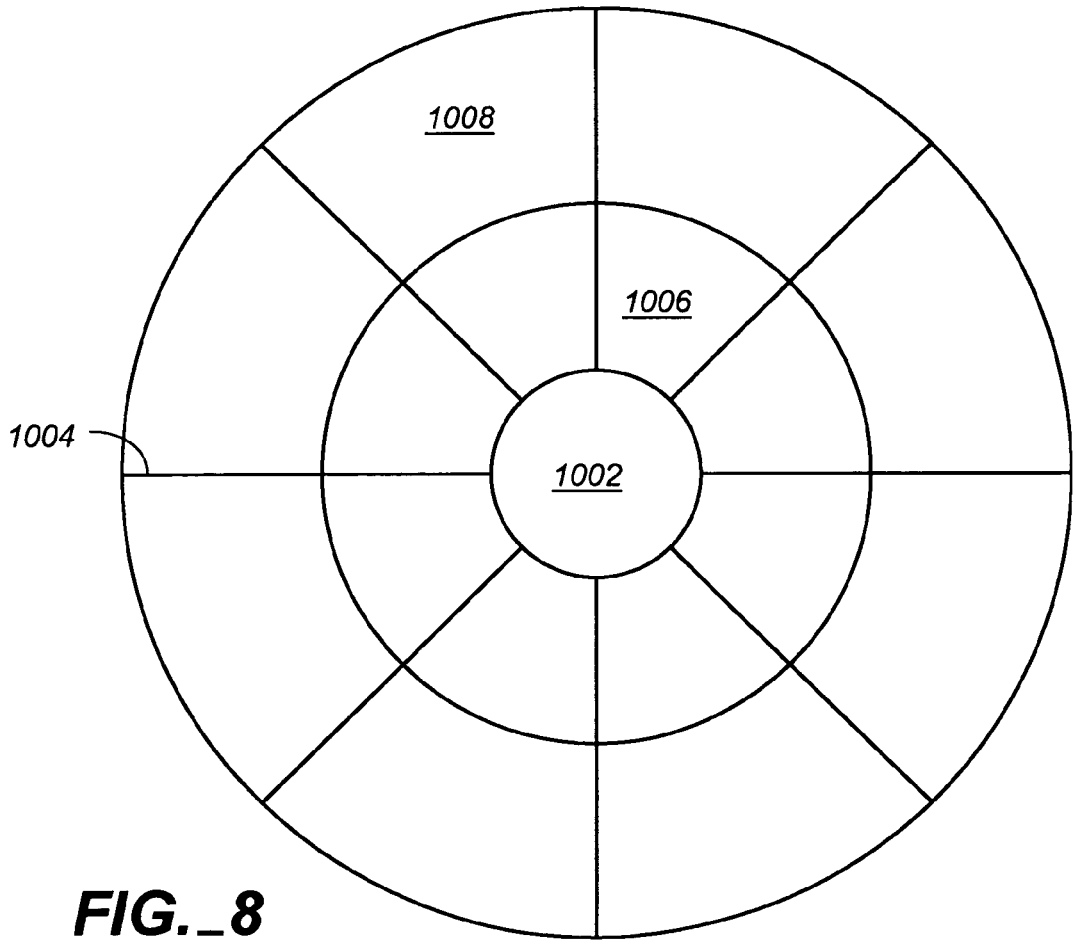
FIG. 8 is a schematic of a membrane with a segmented zone structure.

As another example, in the implementations described above, the chamber and thus the associated zones are radially symmetric. However, the membrane can have a cellular zone structure for asymmetric profile control. The asymmetric profile can be achieved by applying more pressure in one chamber, but not applying the same pressure in an annular zone. For example, as shown in FIG. 8, the sectional structure 1000 can have a central chamber 1002 surrounded by annular rings 1006, 1008 that are divided along the radii 1004 of the membrane to form chambers. A cellular configuration can include a multitude of cells, similar to a honeycomb. Other membrane configurations with different numbers of chambers can also be used. A membrane with a sectional structure 1000 or a cellular configuration can allow for adjusting asymmetry in the substrate profile.

The ability to configure the zones of pressure applied to a substrate during processing can improve the substrate planarizing process. Because planarizing a substrate can cause portions of the substrate to be polished away more quickly than other portions, such as the center, controlling the planarizing process through selectively applying pressure to different areas of the substrate during polishing can assist in achieving a more planar substrate surface. Polishing can occur at different rates across the surface of the substrate. Also, as the characteristics of the carrier head assembly change, such as due to wear, polishing rates at various areas across the substrate can change from substrate to substrate, even with a very stable polishing method. Changing the pressure applied to one area or another of a substrate during polishing can compensate for these changes. However, increasing the number of areas to which pressure can be applied can increase the number of pressure inputs required in the carrier head.

Adding a pressure routing assembly can increase the flexibility of a carrier head with respect to applying pressure to select portions of a substrate during polishing. The pressure routing assembly can enable just a few pressure inputs to be used with a greater number of chambers that are associated with a membrane. The pressure routing assembly can also allow for changing the association between a chamber and a pressure input, such as by changing a valve or changing a connection, such as a tube or manifold.

A pressure routing assembly that includes valves can be changed during polishing. This can allow for software control of the pressure applied to different areas of a substrate. Using a valve to control the pressure input to any number of chambers can allow for as few as two pressure inputs into a carrier head while still providing the flexibility of applying a different pressure to more than two different areas of the substrate during polishing. Further, the size of a pressure zone can be changed during polishing. Fewer pressure inputs than chambers can simplify the carrier head. Almost any type of chamber structure, such as annular, sectional or cellular, can be used in combination with a valve controlled pressure routing assembly.

A combination of valves and dedicated passages leading to chambers also decreases the number of pressure inputs versus to the number of chambers when compared to a carrier head with a separate pressure input for each chamber. That is, there can be more chambers than pressure inputs. The combination of valves and dedicated passages reduces the number of valves used in the pressure routing assembly. Fewer valves decreases the number of working parts that can potentially fail. Chambers of the same pressure can be grouped into independently pressurizable zones. The chambers in communication with a valve can be moved from one zone to another zone, making the zones configurable. The zone configurations can be changed during polishing or between polishing substrates. The ability to configure the zones during polishing can increase the control over the polishing process.

With a manifold system, no valves are between the pressure input and the chambers. Therefore, there are no valves that can potentially fail. Also, no electronics are required within the carrier head, because there are no electrically controlled components, such as valves, to control. The plate body can be removed from the carrier head to change the configuration, such as by changing connections between the chambers and the pressure inputs, or exchanging one plate body for another plate body having the desired manifold configuration.

The configurations of the various elements in the carrier head, such as the relative sizes and spacings, the retaining ring, the base assembly, or the walls in the flexible membrane are illustrative and not limiting. The carrier head could be constructed without a loading chamber, and the base assembly and housing can be a single structure.

A carrier head, as described above, can be used to planarize a substrate by controlling the motion of a substrate relative to a polishing surface. During polishing, a substrate is in contact with the lower surface of the membrane. The carrier head holds the substrate against the polishing surface. The carrier head can move the substrate with respect to the polishing surface, such as by rotating and translating across the polishing surface. The relative movement causes the polishing surface to wear away the uppermost layer of the substrate. Because of the non-uniform rate of polishing that can occur, and the potentially non-uniform surface of the incoming substrate, different pressures can be applied in each chamber to locally increase or decrease the rate of polishing.

During polishing, at any areas that are being polished too quickly the pressure can be reduced by switching to a lower pressure input. Alternatively, the substrate can be measured post-polishing at an in-line measuring station to determine whether the polishing parameters need to be adjusted for continued polishing of the substrate or for polishing of the subsequent substrate. With in situ monitoring, the zones can be altered throughout polishing. Concurrent with the pressure being altered in the individual chambers, the overall pressure applied to the substrate can be changed by applying a downward pressure on the substrate backing assembly.

When the substrate is sufficiently planarized, the relative movement is ceased, and the carrier head removes the substrate from the polishing surface, such as by lifting the substrate away and transferring the substrate to an load and unload station, a rinsing tank or a subsequent polishing surface in a series.

With the techniques described above, as compared to a conventional multi-chambered carrier head, the number of apparent pressure chambers in a carrier head can be increased without a proportionate increase in the number of pressure inputs to the carrier head. Alternatively, the number of pressure inputs may be reduced while maintaining the same number of chambers. Chambers may be grouped to form a set of chambers controlled by a common pressure input, and the members of the set may be configurable. The configuration can be selected by software, and can be changed in-situ during polishing or between polishing operations. The pressure distribution system can be used with many different membrane configurations. The carrier head is adaptable to a variety of polishing processes and parameters. Even with methods that result in relatively reproducible results from polishing one substrate to a next substrate, the carrier head components can wear and the polishing surface can wear. This wearing changes the polishing characteristics across the substrate over time. Control over the inputs at various zones across the substrate can compensate for these changes. The ability to have a selection of zone configurations and to change between different zone configurations may result in better resolution on polishing control. Greater control over the polishing process may result in higher die yield. Uniform film thickness or uniform clearing of a film, such as a copper film, in specific areas may be achieved. Due to the improved flexibility of being able to change configurations, polishing uniformity may be increased, and yield may be improved.

There can be a limit to the number of pneumatic ports in a drive shaft. For any given number of input inputs, more control over the polishing profile may be obtained by adding a chamber to a carrier head assembly and without adding an additional pressure input. Also, the methods and assemblies described herein can be used with existing carrier head structure can be used with some existing carrier heads. By limiting the number of pressure inputs that are required to make a configurable carrier head system, the system may be simpler than a carrier head that requires more pressure inputs. A simpler carrier head system can require fewer parts and be easier to build and maintain.

A number of embodiments of the invention have been described. Nevertheless, it will be understood that various modifications may be made without departing from the spirit and scope of the invention. For example, each of the pressure inputs can supply a different pressure from one another, or the pressure inputs can be adjusted to apply the same pressure. The carrier head needs as few as three chambers, but can have as many chambers as can fit in the span across the back of a substrate. In some embodiments, the chambers can be delineated by o-rings, rather than walls of a membrane. Accordingly, other embodiments are within the scope of the following claims.

What is claimed is:

1. A carrier head for chemical mechanical polishing of a substrate, comprising:

a first passage configured to be connected to a first pressure input and a second passage configured to be connected to a second pressure input;

a base assembly including the first and second passages; and a flexible membrane coupled to the base assembly and having a generally circular main portion with a lower surface that provides a substrate-mounting surface, the volume between the base assembly and the flexible membrane forming a plurality of pressurizable chambers, wherein the first passage is in communication with a first chamber of the plurality of pressurizable chambers and the second passage is in communication with a second chamber of the plurality of pressurizable chambers and there is a greater number of pressurizable chambers than number of passages into the carrier head.

2. The carrier head of claim 1, further comprising an inner membrane that forms at least one of the plurality of pressurizable chambers.

3. The carrier head of claim 1, further comprising a pressure routing assembly within the base assembly that determines which input is in communication with the chamber, wherein the pressure routing assembly includes a plurality of valves, wherein each of the plurality of valves is associated with one of the plurality of pressurizable chambers.

4. The carrier head of claim 3, wherein the plurality of valves include valves that are electronically controlled.

5. The carrier head of claim 3, wherein the plurality of valves include solenoid valves.

6. The carrier head of claim 3, wherein the plurality of valves include MEMS valves.

7. The carrier head of claim 3, wherein the carrier head has an equal number of valves as number of pressurizable chambers.

8. The carrier head of claim 3, wherein the carrier head has a greater number of pressurizable chambers than number of valves.

9. The carrier head of claim 3, wherein the valves are controllable to create a plurality of pressure zones, wherein each zone includes one or more of the plurality of pressurizable chambers.

10. The carrier head of claim 3, wherein the pressure routing assembly is configured to couple either of the first passage or the second passage to each chamber of the plurality of pressurizable chambers.

11. The carrier head of claim 3, further comprising a valve controller, wherein the valve controller controls each of the plurality of valves between a first position and a second position.

12. The carrier head of claim 1, wherein the carrier head further comprises sectioning portions that are secured to the base assembly, wherein the sectioning portions delineate sides of each of the plurality of pressurizable chambers.

13. The carrier head of claim 12, wherein:

the sectioning portions are annular walls; and the plurality of pressurizable chambers are annularly shaped.

14. The carrier head of claim 1, wherein the plurality of pressurizable chambers are configured in a sectional formation.

15. The carrier head of claim 1, wherein the base assembly includes a plate body, which includes a manifold, the manifold fluidly coupling the first and second passages to the plurality of pressurizable chambers.

16. The carrier head of claim 15, wherein the plate body is connected to a part of the base assembly with a fastener.

17. A system for chemical mechanical polishing, comprising:

the carrier head of claim 1; and a drive shaft connected to the carrier head, wherein the drive shaft is configured to rotate the carrier head during polishing.

18. A carrier head for chemical mechanical polishing of a substrate, comprising:

a first passage configured to be connected to a first pressure input and a second passage configured to be connected to a second pressure input;

a base assembly including the first and second passages;

a flexible membrane coupled to the base assembly and having a generally circular main portion with a lower surface that provides a substrate-mounting surface, the volume between the base assembly and the flexible membrane forming a plurality of pressurizable chambers, wherein the first passage is in communication with a first chamber of the plurality of pressurizable chambers and the second passage is in communication with a second chamber of the plurality of pressurizable chambers and there is a greater number of pressurizable chambers than number of passages into the carrier head, and wherein the base assembly includes a plate body which includes a manifold, the manifold fluidly coupling the first and second passages to the plurality of pressurizable chambers, the manifold being reconfigurable, such that a coupling between a first pressurizable chamber to the first passage can be changed to a coupling between the first pressurizable chamber and the second passage.

19. The carrier head of claim 18, wherein changing the coupling of the first pressurizable chamber includes changing a valve position.

20. The carrier head of claim 18, wherein the manifold is part of the plate body and changing the coupling of the first pressurizable chamber includes exchanging the plate body for a plate body having a desired configuration.

21. The carrier head of claim 18, wherein the manifold includes fluid conduits and changing the coupling of the first pressurizable chamber includes changing a connection of a fluid conduit within the manifold.

* * * * *